US012672743B2

(12) United States Patent
Geertsen et al.

(10) Patent No.: US 12,672,743 B2
(45) Date of Patent: Jul. 7, 2026

(54) DISPENSER FOR DISPENSING WEB-SHAPED ABSORBENT MATERIAL FROM A CENTREFEED ROLL

(71) Applicant: Essity Hygiene and Health Aktiebolag, Gothenburg (SE)

(72) Inventors: Thomas Geertsen, Borlänge (SE); Antonio Källgren, Borlänge (SE); Marcus Kullman, Borlänge (SE); Susanne Gungner, Gothenburg (SE); Tomas Gandemo, Gothenburg (SE)

(73) Assignee: ESSITY HYGIENE AND HEALTH AKITEBOLAG, Gothenburg (SE)

( * ) Notice: Subject to any disclaimer, the term of this patent is extended or adjusted under 35 U.S.C. 154(b) by 150 days.

(21) Appl. No.: 18/852,044

(22) PCT Filed: Mar. 31, 2022

(86) PCT No.: PCT/EP2022/058594
§ 371 (c)(1),
(2) Date: Sep. 27, 2024

(87) PCT Pub. No.: WO2023/186310
PCT Pub. Date: Oct. 5, 2023

(65) Prior Publication Data

US 2025/0204728 A1 Jun. 26, 2025

(51) Int. Cl.
*A47K 10/32* (2006.01)

(52) U.S. Cl.
CPC ..... *A47K 10/32* (2013.01); *A47K 2010/3206* (2013.01); *A47K 2010/3233* (2013.01); *A47K 2010/326* (2013.01)

(58) Field of Classification Search
CPC ..... A47K 10/32; A47K 10/3836; A47K 2010/3233
See application file for complete search history.

(56) References Cited

U.S. PATENT DOCUMENTS 5,135,179 A 8/1992 Morano
5,265,816 A * 11/1993 Collins ..... A47K 10/3836 242/560

(Continued)

OTHER PUBLICATIONS

Office Action issued in Chinese Patent Application No. 202280093508.3, dated Jan. 28, 2026, with English Translation (21 pages).

(Continued)

*Primary Examiner* — Gene O Crawford
*Assistant Examiner* — Ayodeji T Ojofeitimi
(74) *Attorney, Agent, or Firm* — BUCHANAN INGERSOLL & ROONEY PC

(57) ABSTRACT

A dispenser for dispensing a web-shaped absorbent material from at least one centrefeed roll comprising a roll compartment for each roll. Each roll compartment is delimited by at least three separate roll compartment surfaces arranged to face an outer periphery of the roll and each roll compartment encompasses an imaginary circle with a radius from a central width axis, each roll compartment surface comprises a roll contact surface portion being arranged so as to contact the circumference of the imaginary circle over an arc of the circumference comprising at least a contact angle from a central height axis, the contact angle of the first roll contact surface portion is 5 to 85 degrees or −5 to −85 degrees; the contact angle (α2) of the second roll contact surface portion is 95 to 175 degrees, and the contact angle of the third roll contact surface portion is −95 to −175 degrees.

25 Claims, 9 Drawing Sheets

(56) References Cited

U.S. PATENT DOCUMENTS

| | | | | |
|---|---|---|---|---|
| 6,364,245 | B1 * | 4/2002 | Paal | A47K 10/3836 225/38 |
| 7,648,097 | B2 * | 1/2010 | Cattacin | A47K 10/3836 242/560 |
| 9,192,268 | B2 | 11/2015 | Denis et al. | |
| 10,327,601 | B2 * | 6/2019 | Bengtsson | A47K 10/32 |
| 2007/0290094 | A1 * | 12/2007 | Anderson | A47K 10/3836 242/594 |
| 2010/0206979 | A1 * | 8/2010 | Collins | A47K 10/36 242/560 |
| 2012/0175455 | A1 | 7/2012 | Denis et al. | |
| 2012/0256036 | A1 * | 10/2012 | Osborne | A47K 10/3662 242/560 |
| 2022/0248916 | A1 * | 8/2022 | Green | A47K 10/38 |

OTHER PUBLICATIONS

International Search Report (PCT/ISA/210) and Written Opinion (PCT/ISA/237) mailed on Oct. 25, 2022, by the European Patent Office as the International Searching Authority for International Application No. PCT/EP2022/058594, 9 pages.

* cited by examiner

DISPENSER FOR DISPENSING WEB-SHAPED ABSORBENT MATERIAL FROM A CENTREFEED ROLL

TECHNICAL FIELD

The invention relates to a dispenser for dispensing web-shaped absorbent material from at least one centrefeed roll of web-shaped absorbent material, such as from a coreless centrefeed roll.

BACKGROUND

Dispensers for dispensing web-shaped absorbent material for wiping or cleaning purposes are widely used. Web-shaped absorbent material such as paper material or non-woven material in the form of e.g. towels or tissue material come in a variety of shapes and sizes. Typically, the web-shaped absorbent material may be provided in the form of a folded stack or in the form of a roll.

Dispensers for web-shaped absorbent material used in public environments require regular refill of web-shaped absorbent material as the prior stack or roll is depleted. The refill is made by service staff regularly watching the status of the dispensers at for example a theatre, a school or an airport. The watching and refilling the dispensers is time-consuming. The time required for watching and refilling may depend on the amount of web material contained in the dispenser, but also on factors such as the occurrence of faults occurring during the dispensing (which may require a premature refill), or the ease and accuracy of the watch of the dispenser.

Therefore, there is a need for a dispenser which provides for efficient watch of the dispenser and/or which provides for a tolerable refilling frequency.

To reduce the need for refilling of a dispenser, it is sometimes suggested to provide dispensers which comprise a greater amount of web-shaped material, i.e. two rolls or more of web-shaped material, rather than one, such that the web material once refilled in the dispenser will last a longer period of time before depleted.

However, due to the confined space in many bathrooms or lavatories, use of a larger dispenser intended to contain e.g. two rolls of web-shaped absorbent material might not be possible.

Dispensers for dispensing web-shaped absorbent material in public environments such as lavatories or toilets are usually adapted to be hanged on a generally vertical wall. As such, the wall surface available for suspending the dispenser is a factor limiting the use of larger dispensers. Further, the dispenser may comprise a cover which when opened allows access to the interior of the dispenser and allows refilling of the dispenser with a new roll of web-shaped absorbent material when the dispenser is depleted or close to depleted. As such, for a particular room such as a toilet, the volume in the room available for swinging out and opening the cover of the dispenser also limits to the size of a dispenser which may be used in that room.

Thus, there is a need for a dispenser for dispensing web-shaped absorbent material which is versatile when it comes to positioning of the dispenser in a room such as a bathroom.

For some applications, it is desired to provide the web-shaped absorbent material in the form of a centrefeed roll, i.e. a roll where it is intended to feed the web material from the centre of the roll, i.e. by pulling the web material in a direction at least partly parallel to the roll centre axis.

The web-shaped absorbent material may for example be a perforated absorbent material, where perforation lines arranged transverse the length of the web divide the web-shaped material into individual products.

Dispensers for dispensing perforated web-shaped absorbent materials may be provided with a dispensing element, such as a nozzle, adapted to ensure that the web-shaped absorbent material is separated along the perforation lines when dispensed. As such, the dispenser may provide for one-by-one product dispensing of individual products.

The dispenser may be designed so as to enable correct dispensing of the web-shaped material from the centre feed roll with the roll in a designated position inside the dispenser. For example, the reliable separation along the perforation lines in a dispenser having a nozzle as mentioned in the above may depend on the position of the centre axis of the roll in relation to the position of the nozzle.

Thus, there is a need for a dispenser for dispensing web-shaped material from a centrefeed roll of web-shaped material, which provides for correct dispensing of web-shaped material from the start of a new roll, until the roll is depleted. There is also a need for a dispenser providing for correct dispensing of web-shaped material when the dispensing involves separation of the web material along perforation lines dividing the web material into individual products, such as when the dispenser comprises a nozzle adapted for separation of the web material along perforation lines.

Further, centrefeed rolls may risk collapsing when an amount of web-shaped material has been fed out from the centre of the original roll. In this case, the outer periphery of the roll may collapse, and the roll material fall inward towards the centre of the roll and/or in a downward direction. Collapse of the roll generally occurs when only the last few rounds of the web-shaped material remain.

As such, there is a need for a dispenser for dispensing web-shaped material from a centrefeed roll of web-shaped material, which avoid premature collapse of the roll, and/or which delays or inhibits collapse of the roll.

SUMMARY

An object of the invention is to provide a dispenser for dispensing web-shaped material from a centrefeed roll which provides an improvement or an alternative in view of one or more of the above-mentioned needs.

According to a first aspect of the invention, the object is achieved by a dispenser according to claim 1.

Thus, there is provided a dispenser for dispensing a web-shaped absorbent material from at least one centrefeed roll of the web-shaped absorbent material, the roll defining a central roll axis. The dispenser extends along a length direction, a height direction perpendicular to the length direction, and a width direction perpendicular to the length direction and the height direction. The dispenser comprises a housing defining one or more roll compartments, each roll compartment being dimensioned for holding one roll of web-shaped absorbent material during dispensing thereof, such that the roll axis is essentially parallel to the width direction. Each roll compartment is delimited by at least three separate roll compartment surfaces arranged to face an outer periphery of the roll in direction perpendicular to the roll axis, and each roll compartment defining a central width axis parallel to the width direction, and a central height axis parallel to the height direction and crossing the width axis. As seen in a direction projection of the dispenser in the width direction, each roll compartment encompasses an imaginary circle with a radius from the central width axis, and each roll compartment surface comprises a roll contact surface portion being arranged so as to contact the circumference of the imaginary circle over an arc of the circumference comprising at least a contact angle measured clockwise from the central height axis. The contact angle of the first roll contact surface portion is located in the range from 5 to 85 degrees or alternatively in the range from −5 to −85 degrees, the contact angle of the second roll contact surface portion is located in the range from 95 to 175 degrees, and the contact angle of the third roll contact surface portion is located in the range from −95 to −175 degrees.

As such, as seen in a direction projection of the dispenser in the width direction, the roll compartment is limited by three contact surface portions, each contact surface portion being located a distance corresponding to the radius of the imaginary circle from the central width axis of the roll compartment.

Hence, a roll of web-shaped material having an outer periphery with a radius corresponding to the radius of the imaginary circle is insertable in the roll compartment such that the central axis of the roll essentially coincides with the central width axis of the roll compartment. The three contact surface portions will contact the outer circumference of the roll at three different positions along the periphery of the roll, so as to support and maintain the roll in an intended roll position in the roll compartment.

By virtue of the distribution of the contact surface portion around the circumference of the imaginary circle as set out in the above, a normal to the contact surface portion at the contact angle will have a component in each one out of the length and height directions of the dispenser. Thus, each contact surface portion will, at least at the contact angle, support a roll inside the roll compartment in both the length direction and the height direction. This implies that each contact surface portion is efficient to support and maintain the roll in the compartment regardless of whether the dispenser is arranged with the height direction of the dispenser aligned with a vertical direction or with the length direction of the dispenser aligned with a vertical direction. Thus, the three contact surface portions arranged over an arc of the circumference of the imaginary circle at least comprising the three different contact angles as set out in the above, provides for versatility when it comes to the positioning of the dispenser with regard to a vertical direction, i.e. to the force of gravity.

That the three contact surface portions are separate, arranged so as to contact the circumference of the imaginary circle over an arc of the circumference and distributed as set out in the above around the circumference of the imaginary circle, further implies that roll compartment may provide for extended space radially outside of the imaginary circle along the portions of the circumference of the imaginary circle not contacted by the contact surface portions. Thus, a roll being introduced in the roll compartment may extend beyond the imaginary circle along the portions of the circumference of the imaginary circle not contacted by the contact surface portions. This implies that the roll may be slightly distorted, however, the arrangement allows for taking up manufacturing tolerances of the rolls, and facilitates easy arrangement of a roll in the roll compartment.

Optionally, one or two of the roll contact surface portions is arranged so as to contact the circumference of the imaginary circle over an arc of the circumference being less than a 5 degree arc of the circumference, such as less than a 2 degree arc of the circumference.

Optionally, each roll contact surface portion is arranged so as to contact the circumference of the imaginary circle over an arc of the circumference being less than a 5 degree arc of the circumference. For example, each roll contact surface portion may be arranged so as to contact the circumference of the imaginary circle over an arc of the circumference being less than a 2 degree arc of the circumference.

As such, each roll contact surface portion may be arranged so as to contact a relatively small portion of the circumference of the imaginary circle. This is sufficient for providing the desired support for the roll, and to provide the above-mentioned versatility in view of the positioning of the dispenser in relation to a vertical direction. Further, the roll contact surface portions extending over a relatively small portion of the circumference of the imaginary circle may facilitate insertion of the roll in the roll compartment and tolerance for manufacturing variations of the rolls.

Optionally, one, two or each of the roll contact surface portions may be arranged so as to contact the circumference of the imaginary circle essentially only at the contact angle of the respective roll contact surface portion. As such, the roll contact surface portion may form a tangent to the imaginary circle with the point of tangency located at the contact angle.

Optionally, the contact angle of the first roll contact surface portion is located in the range from 5 to 30 degrees or alternatively located in the range from −5 to −30 degrees. For example, the contact angle of the first roll contact surface portion may be located in the range from 5 to 20 degrees or alternatively −5 to −20 degrees. This implies that the first roll contact surface portion is located relatively close to the central height axis, thus ensuring that the first roll contact surface portion will be effective to support the roll from the below, when the dispenser is arranged with the height direction parallel to a vertical direction, whilst still providing support in both the height direction and the length direction of the dispenser.

Optionally, the contact angle of the second roll contact surface portion is located in the range from 100 to 140 degrees. For example, the contact angle of the second roll contact surface portion is located in the range from 110 to 130 degrees. This implies that the second roll contact surface portion is located relatively close to a central length axis, as defined parallel to the length direction and through the central width axis. As such, it may be ensured that the second roll contact surface portion will be effective to support the roll from the below, when the dispenser is arranged with the length direction parallel to a vertical direction, whilst still providing support in both the height direction and the length direction of the dispenser.

Optionally, the contact angle of the third roll contact surface portion is located in the range from −100 to −140 degrees. For example, the contact angle of the third roll contact surface portion is located in the range from −110 to −130 degrees. This implies that the third roll contact surface portion is located relatively close to a central length axis, as defined parallel to the length direction and through the central width axis. As such, it may be ensured that the third roll contact surface portion will be effective to support the roll from the below, when the dispenser is arranged with the length direction parallel to a vertical direction, whilst still providing support in both the height direction and the length direction of the dispenser.

Optionally, no more than six roll contact surface portions are arranged so as to contact the circumference of the imaginary circle, such as no more than five roll contact surface portions or no more than four roll contact surface portions.

Optionally, no more than the three roll contact surface portions are arranged so as to contact the circumference of the imaginary circle. As explained in the above, the provision of three roll contact surface portions is sufficient to achieve several advantages in view of versatility in positioning the dispenser and tolerance to manufacturing variations amongst the rolls. As such, limiting the number of roll contact surface portions enables efficiency in terms of manufacturing and/or reducing the amount of material required for manufacturing the dispenser.

Optionally, one or more, such as one, two or three out of the roll compartment surfaces may further comprise an extension surface portion arranged radially outside the circumference of the imaginary circle, as seen from the central width axis.

Optionally, each of the roll compartment surfaces may further comprise an extension surface portion arranged radially outside the circumference of the imaginary circle, as seen from the central width axis As such, a roll compartment surface may comprise the roll contact surface portion, arranged to contact the circumference of the imaginary circle, followed by an extension surface portion arranged not to contact the circumference of the imaginary circle. As such, the extension surface portion will be located a distance greater than the radius of the imaginary circle from the central width axis. Thus, at the extension surface portion, there is room for a roll introduced in the roll compartment to deviate at least slightly from the circumference of the imaginary circle. As such, it may be that in practical circumstances, a roll present in the roll compartment may contact not only the roll contact surface portion, but also the extension surface portion of a roll compartment surface. As such, the extension surface portion may further assist in supporting and holding the roll in position in the roll compartment.

Optionally, the extension surface portion is arranged outside the circumference of the imaginary circle over an arc of the circumference comprising at least an extension angle as measured clockwise from the central height axis.

Optionally, the extension surface portion of the first, second, and/or third roll compartment surface may have an angular extension being greater than the angular extension of the corresponding first, second or third roll contact surface portion. For example, the angular extension of the extension surface portion of the first, second and/or third roll compartment surface may be at least three times the angular extension of the corresponding roll contact surface portion, such as at least five times the angular extension of the corresponding roll contact surface portion.

Optionally, the extension angle of the first extension surface portion is 0 degrees. This implies that the first extension surface extends over an arc crossing the central height axis of the roll compartment. As such, the first extension surface may be efficient for supporting the roll from below when the dispenser is arranged with the height direction of the dispenser parallel to a vertical direction. As mentioned in the above, the roll of web-shaped material risks collapsing when only a small amount of the web-shaped material remains to be dispensed. In this situation, the roll may no longer be able to maintain a close to circular periphery, but instead the last amount of web material may fall vertically downwards. As such, the first extension surface may be available for supporting this last amount of web material.

Alternatively or in addition, the extension angle of the second extension surface portion is 90 degrees. This implies that the second extension surface portion extends over an arc crossing the central length axis of the roll compartment. As such, the first extension surface portion may be efficient for supporting the roll from below when the dispenser is arranged with the length direction of the dispenser parallel to a vertical direction, with similar advantages as those set out in the above for the first extension surface portion.

Alternatively or in addition, the extension angle of the third extension surface portion is −90 degrees. This implies that the third extension surface portion extends over an arc crossing the central length axis of the roll compartment. As such, the first extension surface portion may be efficient for supporting the roll from below when the dispenser is arranged with the length direction of the dispenser parallel to a vertical direction, with similar advantages as those set out in the above for the first extension surface portion.

Optionally, one or more of the first, second and third roll compartment surfaces may be a curved surface following the arc of a circle having a radius of curvature being greater than the radius R of the imaginary circle.

Optionally, one or more of the first, second and third roll compartment surfaces may be a curved surface having a radius of curvature being greater than the radius of the imaginary circle.

As such, to form the roll contact surface portion contacting the periphery of the imaginary circle and an extension surface portion not contacting the periphery of the imaginary circle, the starting point for the radius of curvature of the roll compartment surface will generally not coincide with the central width axis of the roll compartment.

Optionally, one, two or three, for example each of the first, second and/or third roll compartment surfaces has an angular extension about the centre width axis being at least 30 degrees.

Optionally, one, two or three, for example each of the first, second and/or third roll compartment surfaces has an angular extension about the centre axis being no more than 90 degrees.

Optionally, the first roll compartment surface has an angular extension about the circumference of the imaginary circle being in the range from 30 from to 90 degrees.

Optionally, the roll contact surface portions of the first, second and third roll compartment surfaces are located in the same plane perpendicular to the width direction. As such, the roll contact surface portions will act to support the roll in the roll compartment by contacting the roll at least in a same plane perpendicular to the width direction.

Optionally, the dispenser has a dispenser width in the width direction and the roll contact surface portions extend continuously over at least a portion of the dispenser width. That the roll contact surface portions extend continuously over a portion of the dispenser width implies that, along the portion of the dispenser width, all cross sections (perpendicular to the dispenser width) of the roll contact surface portions delimiting the roll compartment are identical. As such, the roll contact surfaces delimiting the roll compartment may display a continuous shape over the portion of the dispenser width.

For example, the roll contact surface portions may extend continuously over at least 50% of the dispenser width.

For example, the roll contact surface portions may extend continuously over at least 50%, such as at least 75%, or essentially the entire width of the roll compartment.

Similarly, the roll compartment surfaces may extend continuously over at least a portion of the dispenser width, such as at least 50% of the dispenser width. For example, the roll compartment surfaces may extend continuously over at least 50%, such as at least 75%, or essentially the entire width of the roll compartment.

In other alternatives, the roll contact surface portions may extend intermittently over at least a portion of the dispenser width, such as along at least 50% of the dispenser width. As such, the roll contact surface portions may extend intermittently over a portion of the dispenser width implies that width segments comprising roll contact surface portions are arranged intermittently with width segments not comprising roll contact surface portions, as seen in the width direction. As such, the roll compartment may be delimited by surfaces having a waved or serrated shape as seen along the width direction.

The dispenser may have a dispenser length in the length direction and a dispenser height in the height direction. Optionally, the dispenser length may be different from the dispenser height. When the dispenser length is different from the dispenser height, the above-mentioned versatility when it comes to arranging the dispenser with the length direction or the width direction generally parallel to a vertical direction provides for more options for arranging the dispenser in e.g. a bathroom with limited available space.

For example, the dispenser length may be at least 1.5× the dispenser height, such as at least 2× the dispenser height.

Optionally, the housing comprises a first roll compartment and a second roll compartment, the first and second roll compartments being arranged adjacent one another as seen in the length direction of the dispenser. The arrangement of two roll compartments in one dispenser diminishes the need for frequent refilling and watch of the dispenser. However, this implies that the dispenser length may be different from the dispenser height, for example, the dispenser length may be about 2× the dispenser height. As such, the advantages mentioned in the above relating to versatility when arranging the dispenser in e.g. a bathroom with limited available space may be particularly desired for a dispenser comprising at least two roll compartments.

Optionally, for a dispenser comprising at least two roll compartments, the central width axis of the first roll compartment and the central width axis of the second roll compartment may be arranged such that the central length axis parallel to the length direction and through the central width axis of the first roll compartment, and the central length axis parallel to the length direction and through the central width axis of the second roll compartment coincides.

Optionally, each roll compartment is delimited by a first roll support member forming the first roll compartment surface, a second roll support member forming the second roll compartment surface, and a third roll support member forming the third roll compartment surface, wherein each of the first, second and third roll support members of the roll compartment is an individual member.

Optionally, each one of the first, second and/or third roll support members may be a separate member being attached to the remainder of the housing. As such, the first, second and third roll support members may be formed by a material being different from the material in other parts of the housing, such as for example from the material in the side walls or cover of the housing. As such, the material for the first, second and third roll support members may be selected without concern to the particular demands which may exist for visible parts of the dispenser. For example, visible parts of the dispenser may need to be formed by materials fulfilling strength requirements so as to withstand outer loads, and/or aesthetic requirements so as to provide the dispenser with a pleasing exterior. By enabling forming the roll support members by a different material from the remainder of the housing, the possibility to select materials which are for example advantageous out of an environmental point of view, such as fully or partly recycled plastic materials is provided.

Optionally, the first, second and/or third roll support member may be removably attached to the remainder of the housing. As such, the first, second and/or third roll support member may be removably attached to e.g. the back wall and/or to a side wall of the housing. As such, this enables the removal of worn out or broken roll support member from the dispenser, and replacement with a new roll support member.

Optionally, a roll compartment surface of the first roll compartment and a roll compartment surface of the second roll compartment may be formed by opposite sides of a single roll support member.

For example, the third roll contact surface of the first roll compartment and the second roll contact surface of the second roll compartment may be formed by opposite sides of a shared roll support member. The shared roll support member would hence be defined as the third roll support member of the first roll compartment, and the second roll support member of the second roll compartment.

Optionally, for each of the one or more roll compartments, the dispenser defines one dispensing opening arranged for dispensing of web material from the roll compartment to the outside of the dispenser at least along the width direction.

The location of the dispensing opening in relation to the central roll axis of the centrefeed roll to be positioned in the roll compartment may be of importance for correct dispensing. As such, the versatility mentioned in the above as regards the orientation of the dispenser with the height or with direction generally parallel to a vertical direction, also implies that it is possible to ensure that the central roll axis of the roll remains suitably positioned in relation to the dispenser opening regardless of the orientation of the dispenser.

Optionally, the dispensing opening may be located adjacent the central width axis of the roll compartment, as seen in a plane perpendicular to the central width axis. For example, the dispensing opening may be arranged such that the central width axis extends through the dispensing opening. For example, the dispensing opening may be such that the central width axis extends centrally through the dispensing opening.

Optionally, the dispenser may comprise a nozzle forming the dispensing opening. Such a nozzle may be adapted for separating the web-shaped absorbent material along perforation lines into individual tissue products. For example, the nozzle may form a generally conical dispensing portion through which the web-shaped absorbent material is to be fed during dispensing.

Optionally, the housing further comprises a suspension arrangement adapted for suspending the dispenser to a generally vertical structure, such as a wall.

Optionally, the suspension arrangement may be adapted for suspending the dispenser to a generally vertical structure with the height direction of the dispenser substantially extending along a vertical direction, and for alternatively suspending the dispenser to a generally vertical structure with the length direction of the dispenser substantially extending along a vertical direction. As such, the suspension arrangement may enable the arrangement of the dispenser in at least two different orientations on a generally vertical structure.

Optionally, the housing comprises a back wall extending generally in the length direction and in the height direction. The dispenser may be adapted to be arranged to a wall, such as a generally vertical wall, with the back wall directed towards the wall. Optionally, the back wall may comprise the suspension arrangement mentioned in the above.

Optionally, the housing further comprises a first pair of opposing side walls extending from the back wall and generally in the width direction and the height direction. Optionally, the housing further comprises a second pair of opposing side walls extending from the back wall and generally in the width direction and in the length direction.

For example, the roll support members as mentioned in the above may be arranged in the housing by one or more of the roll support members being arranged to the back wall and/or to any one of the side walls of the housing.

Optionally, the dispenser comprises a cover arranged to the housing so as to assume an open position, in which a roll of web-shaped material is introducible in at least one of the one or more roll compartments, and a closed position, allowing dispensing of web-shaped material from a roll of web-shaped material when present in the roll compartment.

As such, the cover may extend generally in the width direction and the height direction of the dispenser.

The cover may comprise a dispensing opening as mentioned in the above.

One single cover may be arranged at a housing comprising more than one roll compartment, such as two roll compartments. In this case, the single cover may comprise a dispensing opening for each roll compartment, for example, the cover may comprise two dispensing openings.

Alternatively, when the housing comprises more than one roll compartment, the dispenser may comprise more than one cover, such as one cover extending over each roll compartment of the housing. In this case, each cover may comprise a dispensing opening.

Optionally, the cover or covers may be hinged to the housing. As such, the cover or covers may be hinged to a side wall of the housing.

Optionally, the dispenser may comprise a locking device for locking the cover or covers to the housing.

In the above explanation of the versatility obtained by the proposed dispenser as regards the orientation of the dispenser in relation to generally vertical direction, two primary orientations are specifically mentioned, namely the orientation of the dispenser with the height axis generally parallel to the vertical direction and the orientation of the dispenser with the length axis generally parallel to the vertical direction. However, even if these two orientations may be the most suitable for arrangement of the dispenser to a generally vertical wall, it is to be understood that the dispenser proposed herein may also be arranged in orientations where neither the length axis of the dispenser or the height axis of the dispenser is generally parallel to the vertical direction. As such, proper function of the dispenser may be obtained also for other orientations, which may further improve the versatility of the dispenser and provide for numerous possibilities when it comes to arranging the dispenser in locations where space is limited.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLES OF THE INVENTION

Figure 1:
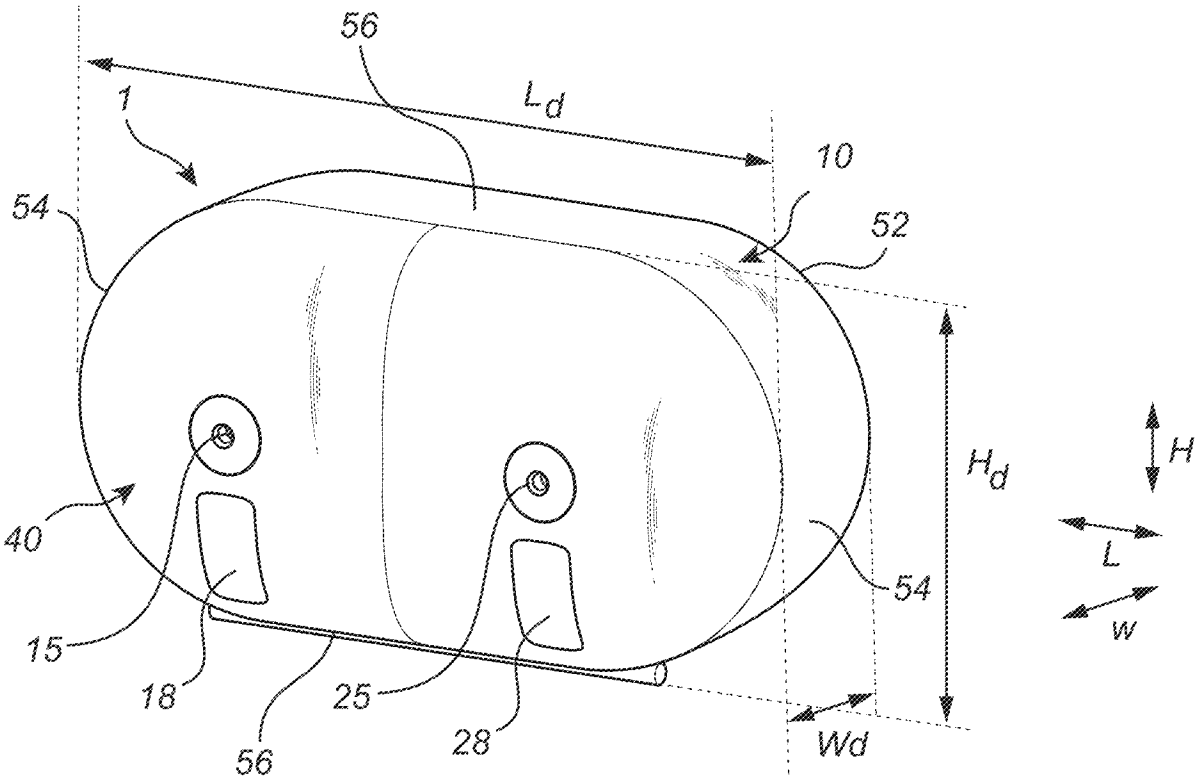
FIG. 1 is a perspective view of a dispenser according to a variant of the dispenser as proposed herein, when in a closed state.

FIG. 1 depicts an example of a dispenser 1 for dispensing web-shaped absorbent material from at least one centrefeed roll of web-shaped absorbent material. As outlined in the above, the web-shaped absorbent material may be any material suitable for cleaning and/or wiping purposes. For example, the web-shaped absorbent material may be a paper tissue or towel material or a non-woven tissue or towel material. Further, the web-shaped absorbent material is intended to be separated into individual portions or products before use. In some variants, the separation may be made at controlled locations along the web material, whereas in other variants, the separation may be made anywhere along the web-shaped absorbent material, as selected by the user, to receive a portion of the web-shaped absorbent material having a length suitable for the cleaning or wiping purpose. For example, the web-shaped absorbent material may be provided with perforation lines or other weakening lines facilitating the separation of the web material into individual products.

To accomplish the separation into individual portions or products, the dispenser 1 may be provided with suitable separation means.

The web-shaped material may typically be a disposable material, i.e. a material which is used only once or a few times and then discarded.

A roll of web-shaped absorbent material defines an imaginary roll axis X about which the web-shaped absorbent material is wound. A centrefeed roll of web-shaped absorbent material is a roll from which dispensing of web-shaped absorbent material is intended to take place from an absorbent material tail closest to the roll axis X. In some examples of centrefeed rolls, the initial absorbent material tail is located at or adjacent to the roll axis X. In other examples of centrefeed rolls, the roll is formed having an inner radius extending some distance from the roll axis X.

The centrefeed roll may be formed as a coreless roll. Alternatively, the centrefeed roll may be formed with a removable core, where the removable core is removed from the roll before dispensing of web-shaped material from the roll, e.g. a split-core.

As exemplified in FIG. 1, the dispenser 1 extends along a length direction L, a height direction H perpendicular to the length direction L, and a width direction W perpendicular to the length direction L and the height direction H. As such, the dispenser has a dispenser length Ld along the length direction, a dispenser height Hd along the height direction, and a dispenser width along the width direction Wd. The dispenser height Hd, length Ld, and width Wd may be adapted to enable the dispenser 1 to house the size of the roll or rolls to be accommodated in the dispenser. The length direction L, height direction H and width direction W refer to the dispenser 1. Although one possible orientation as illustrated in FIG. 1 is with the height direction H of the dispenser generally parallel to a vertical direction, and the length direction L of the dispenser generally parallel to a horizontal direction, other orientations of the dispenser in relation to a vertical and a horizontal direction are possible, as will be explained in the below.

Purely by way of example, as illustrated in FIG. 1, the dispenser 1 may be adapted for holding more than one roll of web-shaped absorbent material, such as the illustrated variant which is adapted for holding two rolls of web-shaped absorbent material.

For example, the dispenser length Ld may be greater than the dispenser height Hd. In the variant illustrated in FIGS. 1 to 3, the dispenser length Ld is at least 1.5× the dispenser height Hd, and may be at least 2× the dispenser height Hd.

Figure 2:
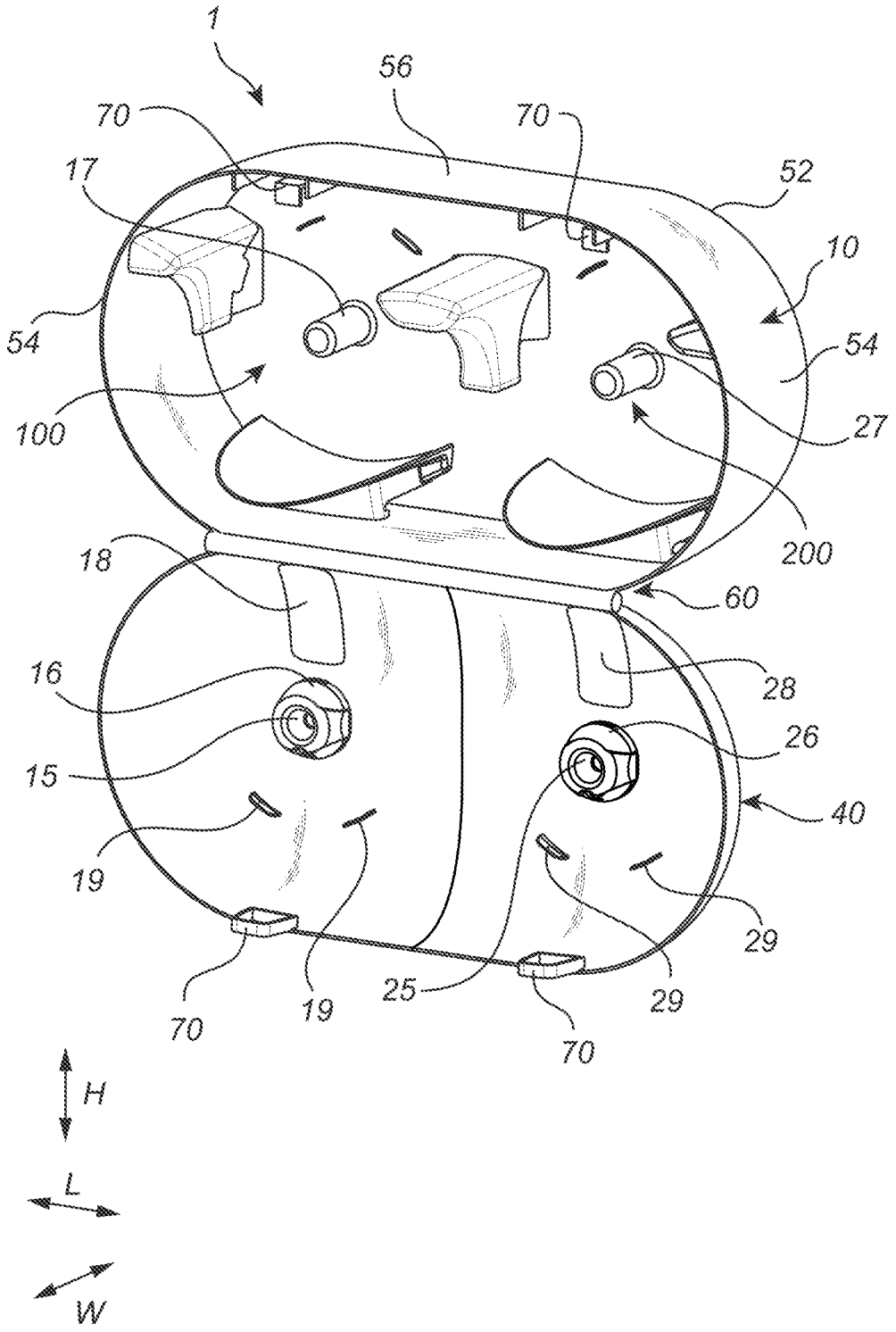
FIG. 2 is a perspective view of the dispenser of FIG. 1, when in an open state.

The dispenser 1 comprises a housing 10 defining one or more roll compartments 100, 200 see FIG. 2, each roll compartment 100, 200 being dimensioned for holding one roll of web-shaped absorbent material during dispensing thereof, such that the roll axis of the one or more rolls is generally parallel with the width direction W of the dispenser.

Figure 3:
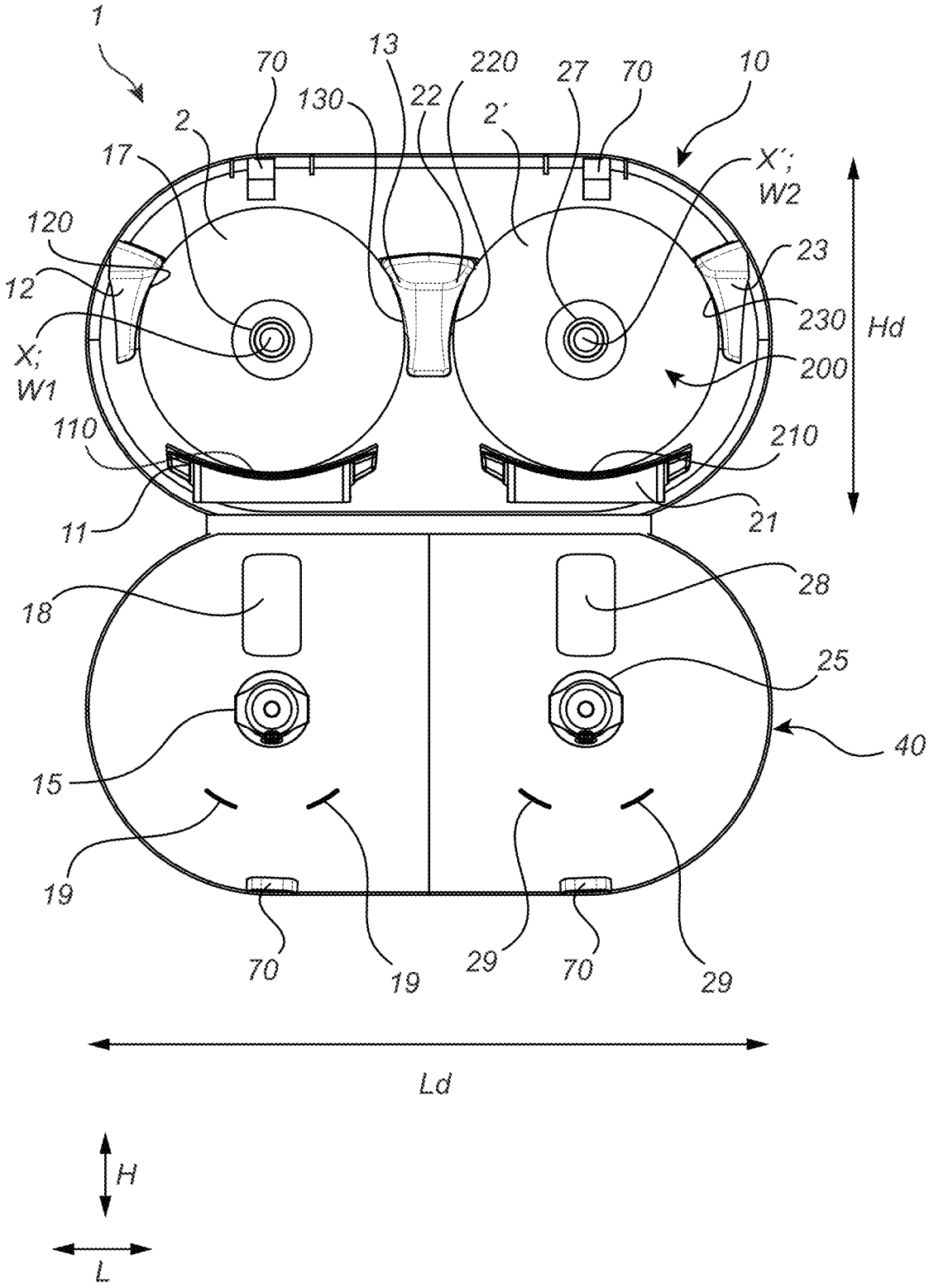
FIG. 3 is a front view of the dispenser of FIGS. 1 and 2, when in an open state and with two rolls of web-shaped absorbent material arranged in the dispenser.

As exemplified in FIGS. 1 to 3, for each of the one or more roll compartments 100, 200, the dispenser may define one dispensing opening 15, 25 arranged for dispensing of web material from the roll compartment 100, 200 to the outside of the dispenser 1 at least along the width direction W.

As exemplified in FIG. 1, the dispenser 1 may have a closed state, in which the dispenser 1 forms a closed exterior periphery apart from the one or more dispensing openings 15, 25, which communicate with the interior of the dispenser 1 to allow dispensing of web material from one or more rolls arranged in the dispenser 1.

As exemplified in FIG. 2, the dispenser 1 may have another, open state, in which the dispenser 1 is open to the exterior so as to allow introduction of at least one roll of web-shaped material into the dispenser 1.

Purely by way of example, as in the illustrated variant, the introduction of a roll of web-shaped material into the dispenser 1 may be made by introduction of the roll generally along the width direction W of the dispenser 1.

Purely by way of example, and as illustrated in FIG. 2, the dispenser 1 may be a dispenser for dispensing perforated web-shaped absorbent material, and may be provided with a dispensing element adapted to ensure that the web-shaped absorbent material is separated along the perforation lines when dispensed. In the illustrated variant, a dispensing element in the form of a nozzle 16, 26 is arranged for each roll compartment 100, 200. The nozzle 16, 26 may form part of the respective dispensing opening 15, 25. For example, the nozzle 16, 26 may form a conical path for the web-shaped material, which conical path is narrowing towards the dispensing opening 15, 25 so as to enable separation of the web material along the perforation lines by means of friction. As such, the dispenser 1 may provide for one-by-one product dispensing of individual products from the web-shaped material.

Purely by example, and as illustrated in FIGS. 1 to 3, the housing 10 may comprise a back wall 52 extending generally in the length direction L and in the height direction H, i.e. generally perpendicular to the width direction W. Further, purely by way of example, the housing 10 may comprise a first pair of opposing side walls 54 extending from the back wall 52 and generally in the width direction W and the height direction H. Also, the housing 10 may comprise a second pair of opposing side walls 56 extending from the back wall 52 and generally in the width direction W and in the length direction L.

For example, and as illustrated in FIGS. 1 to 3, the dispenser 1 may comprise a cover 40 arranged to the housing 10. The cover 40 may comprise the dispensing opening 15, 25 for each roll compartment 100, 200. Further, the cover 40 may comprise any dispensing elements such as a nozzle 16, 26 for each dispensing opening 15, 25.

For example, and as in FIGS. 1 to 3, the cover 40 may be hinged to the housing 10 by a hinge element 60. The hinge element 60 may be arranged to one of the side walls 54, 56 of the housing 10.

As such, in the closed position, as illustrated in FIG. 1, the cover 40 and the housing 10 form a closed exterior of the dispenser 10, apart from the dispensing openings 15, 25, through which dispensing of web-shaped material from a roll of web-shaped material when present in the roll compartment is allowed.

In the open position, as illustrated in FIG. 2, the dispenser 1 is open towards the one or more roll compartments 100, 200 such that a new roll may be inserted in the roll compartment 100, 200 by insertion of the roll generally along the width direction W of the dispenser 1.

The dispenser 1 may further comprise one or more windows 18, 28 enabling visual inspection of the content in the one or more roll compartments 100, 200. As such, the one or more windows 18, 28 may be formed by at least partly transparent material and may be arranged so as to enable visual inspection of at least a portion of a roll arranged in the roll compartment 100, 200. Purely by way of example, as illustrated in FIGS. 1 to 3, the windows 18, 28 may be arranged in the cover 40.

The cover 40 which is arranged to the housing 10 may, as in the illustrated example, form a front wall of the dispenser 1, which front wall extends essentially in the height and length directions of the dispenser 1. Further, the cover 40 may comprise cover side wall portions extending generally in the width direction W from the front wall, so as to meet with the side walls 54, 56 of the housing 10 when the dispenser 1 is in a closed state.

For example, and as in the dispenser 1 illustrated in FIGS. 1 to 3, the cover 40 may be configured to cover more than one roll compartment 100, 200, such as a first roll compartment 100 and a second roll compartment 200. In other alternatives, the dispenser 1 may comprise two or more cover portions, each cover portion covering one out of the roll compartments 100, 200 of the dispenser.

Purely as an example, the housing 10 and/or the cover 40 may comprise one or more locking members 70 for locking the dispenser 1 when in the closed state. The locking member(s) 70 may for example be lockable and openable with a key.

Optionally, the dispenser 1 may comprise a suspension arrangement adapted for suspending the dispenser 1 to a generally vertical structure, such as a wall.

Since, as will be further explained in the below, the dispenser 1 proposed herein provides for versatility regarding the orientation of the dispenser 1 in relation to a vertical axis, the suspension arrangement may be adapted for suspending the dispenser to a generally vertical structure with the height direction H of the dispenser 1 substantially extending along a vertical direction, and for alternatively suspending the dispenser to a generally vertical structure with the length direction L of the dispenser 1 substantially extending along a vertical direction. Such a suspension arrangement may for example be provided at the back wall 52 of the housing 10.

For example, such a suspension arrangement may comprise a number of hooks and/or holes on the back wall 52 of the housing, out of which some hooks and/or holes are adapted for use when suspending the dispenser 1 with the height direction H substantially extending along a vertical direction, and some hooks and/or holes are adapted for use when suspending the same dispenser 1 with the width direction W substantially extending along a vertical direction. Alternatively, the same hooks and/or holes may be used for the different orientations of the dispenser 1.

As outlined in the above summary section, to ensure the function of the dispenser 1 when oriented along different directions, it is desired that the one or more rolls 2 are adequately supported in the dispenser 1 and that the centre axis (-es) X of the one or more rolls 2 is/are correctly positioned in relation to the dispensing opening(s) 15, 25, regardless of orientation of the dispenser 1.

To this end, the dispenser 1 comprises the one or more roll compartments 100, 200.

With reference to FIG. 3, each roll compartment 100, 200 is dimensioned for holding one roll 2, 2' of web-shaped absorbent material during dispensing thereof, such that the roll axis X of each roll 2, 2' is essentially parallel to the width direction W.

Each roll compartment 100, 200 is delimited by at least three separate roll compartment surfaces 110, 120, 130; 210, 220, 230 arranged to face an outer periphery of the roll 2, 2' in direction perpendicular to the roll axis X. Each roll compartment 100, 200 defines a central width axis W1, W2 parallel to the width direction W, and a central height axis H1, H2 (see FIG. 4*a*) parallel to the height direction H and crossing the width axis W1, W2. Further as seen in a direction projection of the dispenser 1 in the width direction W, each roll compartment 100, 200 encompasses an imaginary circle with a radius R from the central width axis W1, W2.

Figure 4A:
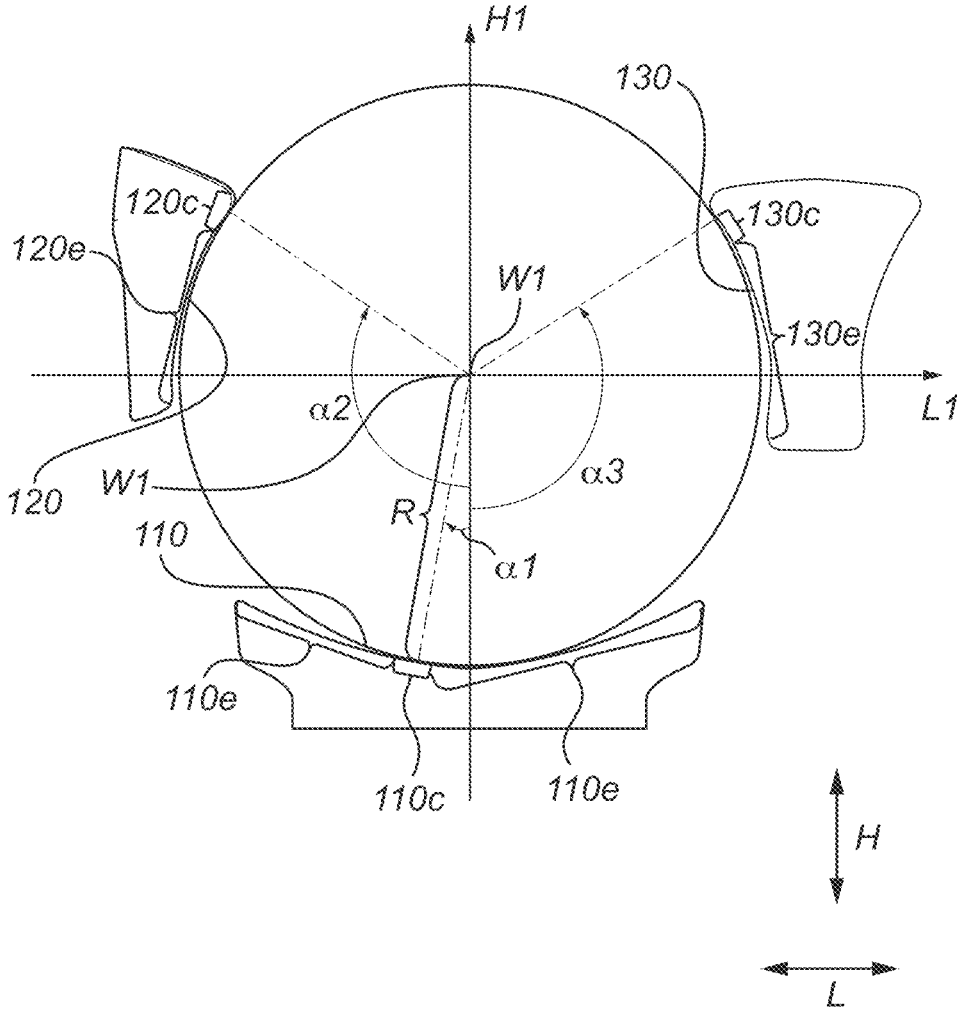
FIGS. 4*a* to 4*c* are schematic views illustrating the roll compartment of the dispenser of FIGS. 1 to 3 when in a first orientation.
Figure 4B:
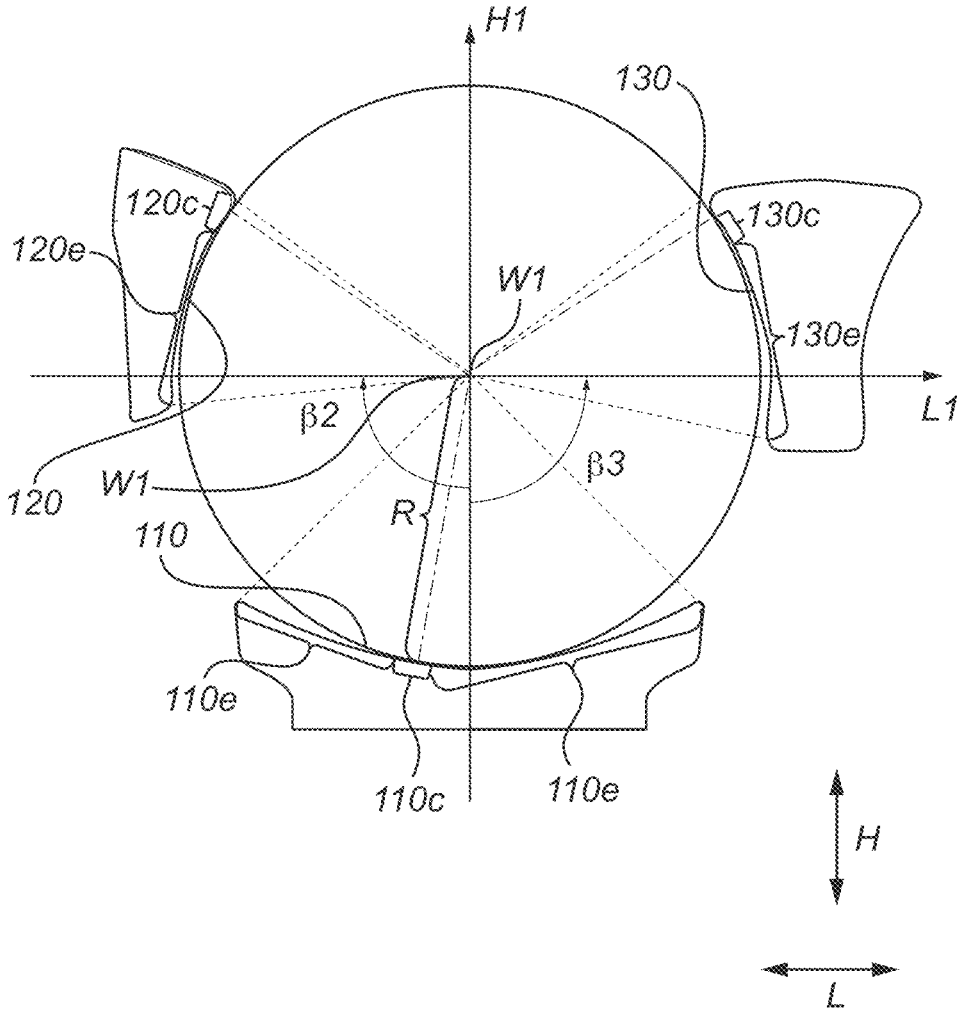
Figure 4C:
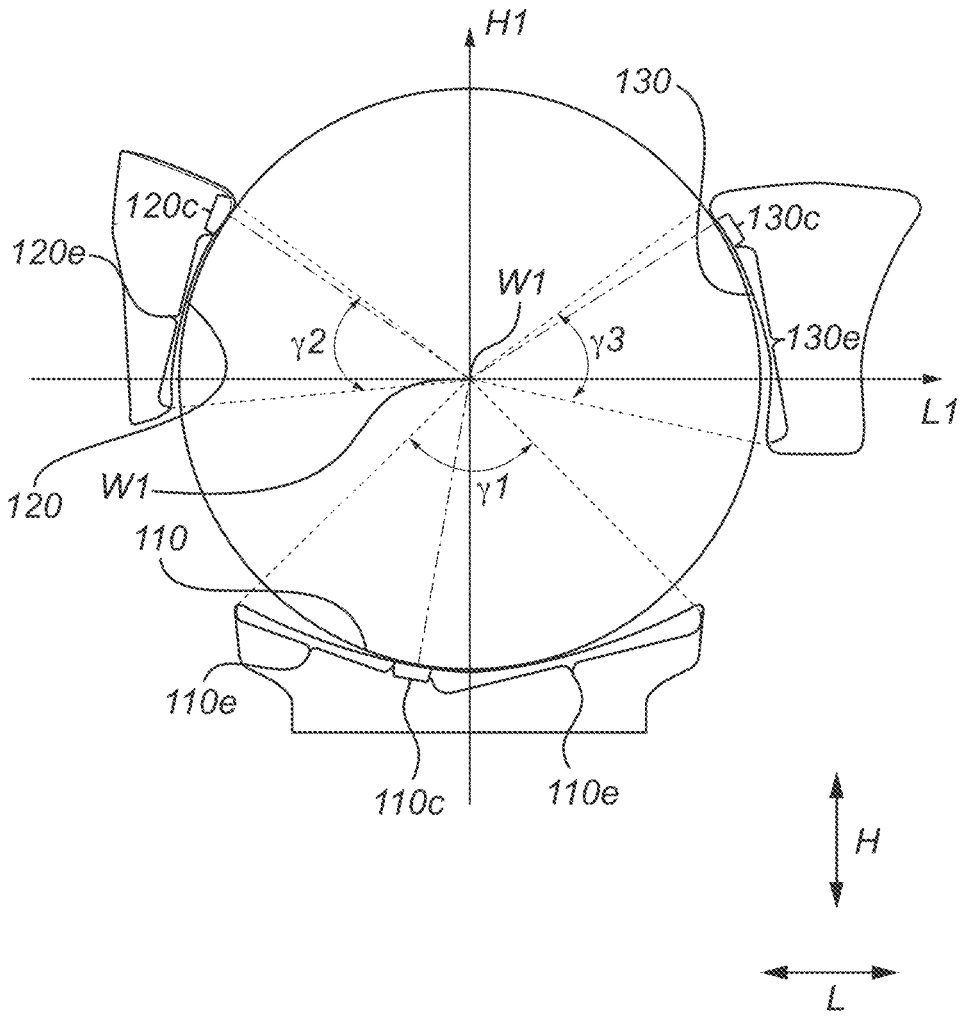

In the following, reference will be made to FIGS. 4*a* to 4*c* depicting a direction projection of the dispenser 1 in the width direction W of one roll compartment such as the first roll compartment 100 of the dispenser illustrated in FIGS. 1 to 3. Thus, the description in the below is equally applicable to one or more roll compartments in a dispenser, such as to the second roll compartment 200 of the dispenser 1 illustrated in FIGS. 1 to 3.

As exemplified in FIGS. 4*a* to 4*c*, each roll compartment surface 110, 120, 130; comprises a roll contact surface portion 110*c*, 120*c*, 130*c* being arranged so as to contact the circumference of the imaginary circle. Thus, the roll contact surface portions 100*c*, 120*c*, 130*c* are all arc shaped surface portions following the periphery of the imaginary circle with the radius R about the centre width axis W1.

Each roll contact surface portion 110*c*, 120*c*, 130*c* thus extends over an arc of the circumference of the imaginary circle. Each roll contact surface portion is positioned on the circumference of the imaginary circle such that the arc of the circumference comprises at least a contact angle α1, α2, α3 as measured clockwise from the central height axis H1. Angle values greater than zero and angle values less than zero relate, as understood from FIG. 4*a*, to angles formed on two opposite sides of the central height axis H1, as seen in the plane spanned by the height and length directions H, L.

The contact angle α1 of the first roll contact surface portion 110*c* is located in the range from 5 to 85 degrees or alternatively located in the range from −5 to −85 degrees.

The contact angle α2 of the second roll contact surface portion 120*c* is located in the range from 95 to 175 degrees.

The contact angle α3 of the third roll contact surface portion 130*c* is located in the range from −95 to −175 degrees.

As such, the roll contact surface portions 110*c*, 120*c*, 130*c* are distributed around the circumference of the imaginary circle around the central width axis W1.

Figure 5:
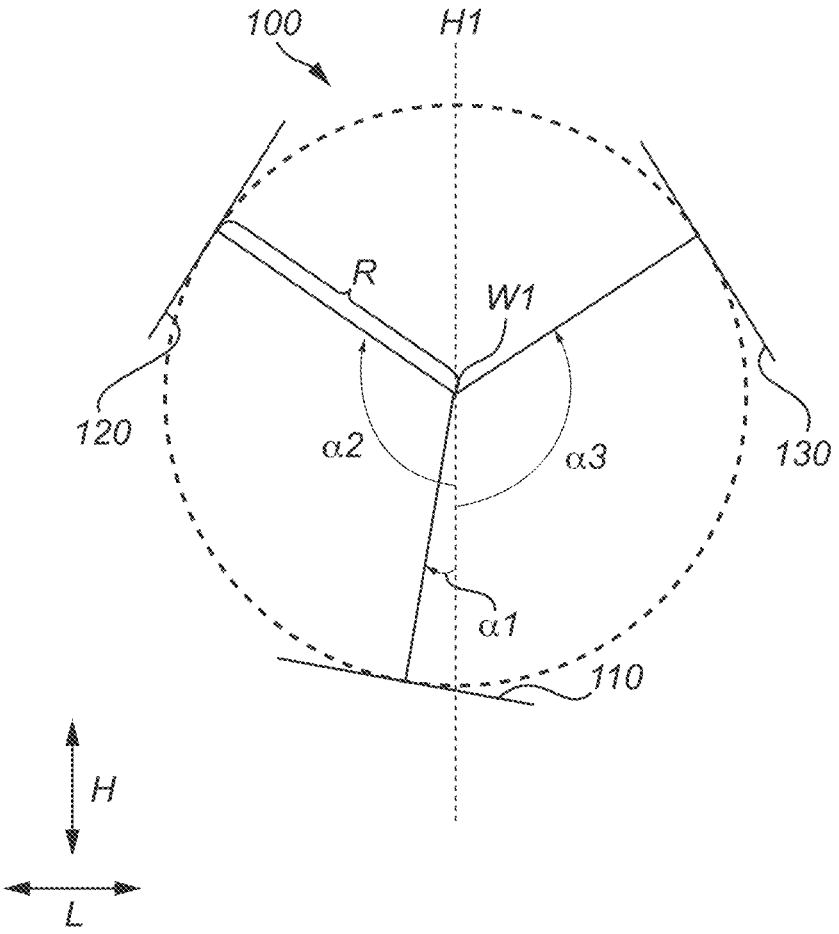
FIG. 5 is another schematic view illustrating the roll compartment of FIGS. 4*a* to 4*c;*

FIG. 5 schematically illustrates the imaginary circle of a roll compartment 100, with the contact radiuses α1, α2, α3 of the three contact surface portions 110*c*, 120*c*, 130*c* marked. As may be seen in FIG. 5, a normal to each contact surface portion 110*c*, 120*c*, 130*c* at the contact angle α1, α2, α3 will have a component in each one out of the length and height directions L, H of the dispenser 1. As outlined in the above, this implies that each contact surface portion 110*c*, 120*c*, 130*c* is efficient to support and maintain the roll in the compartment regardless of whether the dispenser is arranged with the height direction of the dispenser aligned with a vertical direction or with the length direction of the dispenser aligned with a vertical direction. As understood from FIG. 5, the normals to each contact surface portion 110*c*, 120*c*, 130*c* will meet at the central width axis W1. As such, the contact surface portions 110*c*, 120*c*, 130*c* are also efficient to centre the roll 2, i.e. to urge the roll 2 towards a position where the centre axis X of the roll coincides with the central width axis W1.

Optionally, one or two of the roll contact surface portions is arranged so as to contact the circumference of the imaginary circle over an arc of the circumference being less than a 5 degree arc of the circumference, such as less than a 2 degree arc of the circumference.

Optionally, each roll contact surface portion 110*c*, 120*c*, 130*c* is arranged so as to contact the circumference of the imaginary circle over an arc of the circumference being relatively small, such that less than a 5 degree arc of the circumference As may be understood from e.g. FIG. 5, the minimum extension of each roll contact surface portion 100*c*, 120*c*, 130*c* would be a point of tangency as seen in the direction projection of the roll compartment along the width direction, the point of tangency thus being located at the respective contact angle α1, α2, α3. Thus, the roll contact surface portion would be arranged so as to contact the circumference of the imaginary circle essentially only at the respective contact angle α1, α2, α3.

For example, the contact angle α1 of the first roll contact surface portion 110*c* may be located in the range from 5 to 30 degrees or alternatively located in the range from −5 to −30 degrees. Purely as an example, in the illustrated dispenser 1, the contact angle α1 of the first roll contact surface portion is about 10 degrees.

For example, the contact angle α2 of the second roll contact surface portion 120*c* may be located in the range from 100 to 140 degrees, such as from 110 to 130 degrees. Purely as an example, in the illustrated dispenser 1, the contact angle α2 of the second roll contact surface portion is about 115 degrees.

For example, the contact angle α3 of the third roll contact surface portion 130*c* may be located in the range from −100 to −140 degrees, such as from −110 to −130 degrees. Purely as an example, in the illustrated dispenser 1, the contact angle α3 of the third roll contact surface portion is about −120 degrees.

The three roll contact surface portions 110*c*, 120*c*, 130*c* acting so as to support and centre the roll 2 such that the dispenser 1 may be arranged in numerous orientations, are per se sufficient to maintain the roll 2 in the desired position. As such, variants such as the illustrated dispenser 1, wherein no more than the three roll contact surface portions 110*c*, 120*c*, 130*c* are arranged so as to contact the circumference of the imaginary circle are feasible. This provides for efficient manufacturing of the dispenser 1 and may thus be advantageous.

The three roll contact surface portions 110*c*, 120*c*, 130*c* as distributed around the circumference of the imaginary circle will not only support the roll 2 from below regardless of the orientation of the dispenser 1, but also ensure that the central axis X of the roll 2 is centred adjacent or at the centre width axis W1.

As such, the spatial relationship between the central axis X of the roll 2 and the dispensing opening 15 see FIGS. 1 to 3 of the roll compartment 100 may be controlled regardless of the orientation of the dispenser 1, such that correct dispensing of web material from the centre of the roll 2 may be accomplished.

It may be preferred that, when seen in a direction projection of the roll compartment in the width direction W, no portion of the roll compartment extends radially inside of the imaginary radius R. As such, it may be ensured that the three roll contact surface portions are indeed efficient to centre the roll as intended.

However, it may be that in certain variants, an auxiliary element could be provided which, as seen in the direction projection in the width direction W, would indeed extend radially inside of the imaginary radius R. However, such an auxiliary element should be arranged so as not to affect the ability of the three roll contact surface portions to centre the roll in the roll compartment. Accordingly, any such auxiliary element could for example have a relatively limited extension as seen along the width direction W.

Optionally, and as exemplified in FIGS. 4*a* to 4*c*, one, two or three out of the roll compartment surfaces 110, 120, 130 may further comprise an extension surface portion 110*e*, 120*e*, 130*e*, arranged radially outside the circumference of the imaginary circle, as seen from the central width axis W1.

As such, the extension surface portion 110*e*, 120*e*, 130*e* may extend from a roll contact surface portion 110*c*, 120*c*, 130*c*, to an end of the roll compartment surface 110, 120, 130.

The extension surface portions 110*e*, 120*e*, 130*e* may optionally and as illustrated have an angular extension about the centre width axis W1 being greater than the angular extension of the corresponding contact surface portions 110*c*, 120*c*, 130*c*. The extension surface portions 110*e*, 120, 130*e* may for example have an angular extension at least 3 times, such as at least 5 times greater than the angular extension of the corresponding contact surface portions 110*c*, 120*c*, 130*c*.

For example, and as exemplified by the first roll compartment surface 110 of FIGS. 4*a* to 4*c*, the roll compartment surface 110 may comprise two extension surface portions 110*e* having a greater angular extension than the first roll contact surface portion 110*c*. In this case, the two extension surface portions 110*e* may be extending on each side of the roll contact surface portion 110*c*.

In another example, and as exemplified by the second roll compartment surface 120 and the third roll compartment surface 130 of FIG. 4*a*, the roll compartment surface 120, 130 may comprise one extension surface portion 120*e*, 130*e* having a greater angular extension than the second or third roll contact surface portion 120*c*, 130*c*, respectively. In this case, the extension surface portion 120*e*, 130*e* may be extending on one side of the roll contact surface portion 120*c*, 130*c*.

Thus, at the extension surface portions 110*e*, 120*e*, 130*e*, there is room for a roll 2 introduced in the roll compartment 100 to deviate at least slightly from the circumference of the imaginary circle. Although with the roll contact surface portions 110*c*, 120*c*, 130*c* as described in the above, the roll 2 is hindered from premature collapsing, there may nevertheless be some cases where the roll 2 collapses towards the end of the dispensing.

In this case, the roll 2 may fall downwards, and, depending on the direction of the dispenser, the web material of the roll may gather on one of the roll compartment surfaces 110, 120, 130, including the extension surface portions 110*e*, 120*e*, 130*e*.

The extension surface portions 110*e*, 120*e*, 130*e* may extend from the respective roll contact portion 110*c*, 120*c*, 130*c* and so as to extend at least over an extension angle β1, β2, β3 (see FIG. 4*b*). As such, each extension surface portion 110*e*, 120*e*, 130*e* is arranged outside the circumference of the imaginary circle over an arc of the circumference comprising at least the extension angle β1, β2, β3.

For example, and as exemplified in FIG. 4*b*, the extension angle β1 of the first extension surface 110*e* may be 0 degrees (the angle being 0 so not marked in FIG. 4*b*). This implies that the first extension surface 110*e* extends over an arc crossing the central height axis H1 of the roll compartment 100. As such, the first extension surface 110*e* may be efficient for supporting at least a collapsed roll 2 from below when the dispenser 1 is arranged with the height direction H of the dispenser 1 parallel to a vertical direction.

Alternatively or in addition, as illustrated in FIG. 4*b*, the extension angle β2 of the second extension surface 120*e* may be 90 degrees. This implies that the second extension surface 120*e* extends over an arc crossing the central length axis L1 of the roll compartment 100. As such, the second extension surface 120*e* may be efficient for supporting at least a collapsed roll 2 from below when the dispenser 1 is arranged with the length direction L of the dispenser parallel to a vertical direction, and with the second roll compartment surface 120 located below the third roll compartment surface 130.

Alternatively or in addition, as illustrated in FIG. 4*b*, the extension angle β3 of the third extension surface 130*e* may be −90 degrees. This implies that the third extension surface 130*e* extends over an arc crossing the central length axis L1 of the roll compartment 100. As such, the third extension surface 130*e* may be efficient for supporting at least a collapsed roll 2 from below when the dispenser 1 is arranged with the length direction L of the dispenser parallel to a vertical direction, and with the third roll compartment surface 130 located below the second roll compartment surface 120.

As such, the dispenser 1 may be adapted for arrangement in at least three different orientations: one with the height direction H of the dispenser 1 oriented along a vertical axis and the first roll compartment surface 110 located below the first and second roll compartment surfaces 120, 130, one with the length direction L of the dispenser 1 oriented along a vertical axis and the second roll compartment surface 120 located below the first and third roll compartment surfaces 110, 130, and one with the length direction L of the dispenser oriented along a vertical axis and the third roll compartment surface 130 located below the first and second roll compartment surfaces 110, 120.

Purely as an example, one or more of the first, second and third roll compartment surfaces 110, 120, 130 may be a curved surface following the arc of a circle having a radius of curvature being greater than the radius R of the imaginary circle. In this case, the first, second and/or third roll compartment surface 110, 120, 130 may suitably be arranged such that a portion of the first second and/or third roll compartment surface 110, 120, 130 contacts the circumference of the imaginary circle so as to form the first, second and/or third roll contact surface portion 110*c*, 120*c*, 130*c* as described in the above, whereas another portion of the first, second and/or third roll compartment surface 110, 120, 130 is located outside of the circumference of the imaginary circle, so as to form the first second and/or third extension surface portion 110*e*, 120*e*, 130*e* as described in the above. This implies that the starting points of the radii of curvature of the first, second and/or third roll compartment surfaces 110, 120, 130 would not meet in a common central point, and not coincide with the central width axis W1 of the roll compartment 100.

The first, second and/or third roll compartment surface 110, 120, 130 may, as intimated in the above, have an angular extension about the centre width axis W1. The angular extension of a roll compartment surface 110, 120, 130 thus comprises at least the angular extension of the roll contact surface portion 110*c*, 120*c*, 130*c* and any extension surface portions 110*e*, 120*e*, 130*e*.

For example, the first, second and/or third roll compartment surface 110, 120, 130 may have an angular extension about the centre width axis W1 being at least 30 degrees.

Optionally, and as shown in FIG. 4*c*, the first, second and/or third roll compartment surface 110, 120, 130 may have an angular extension γ1, γ2, γ3 about the centre width axis W1 being at least 30 degrees.

Optionally, and as shown in FIG. 4*c*, the first, second and/or third roll compartment surface 110, 120, 130 may have an angular extension γ1, γ2, γ3 about the centre width axis W1 being no more than 90 degrees.

For example, and as shown in FIG. 4*c*, the second and third roll compartment surface 120, 130 may each have an angular extension γ2, γ3 being less than the angular extension γ1 of the first roll compartment surface 110.

In FIGS. 4*a* to 4*c*, a direction projection along the width axis W of the roll compartment 100 is illustrated.

Turning to the extension of the above-mentioned features along the width axis W, several variants are possible while still obtaining the advantages as set out in the above.

For example, the roll contact surface portions 110*c*, 120*c*, 130*c* of the first, second and third roll compartment surfaces 110, 120, 130 may be located in the same plane perpendicular to the width direction W. Thus, in at least one cross-section along the width direction W, the three roll contact surface portions 100*c*, 120*c*, 130*c* will be present and as defined in relation to the direction projection along the width direction. As such, the roll contact surface portions 110*c*, 120*c*, 130*c* will act to support and centre a roll 2 in the roll compartment 100 by contacting the roll 2 at least in a same plane perpendicular to the width direction W.

The dispenser may have a dispenser width Wd as seen in the width direction W (see FIGS. 1 and 2). As such, the roll contact surface portions Optionally, the dispenser has a dispenser width Wd in the width direction W and the roll contact surface portions 110*c*, 120*c*, 130*c* may extend continuously over at least a portion of the dispenser width Wd. For example, the roll contact surface portions may extend continuously over at least 50% of the dispenser width.

As illustrated in FIGS. 4*a* to 4*c* in view of FIGS. 1 to 3, in an example variant, each roll compartment 100, 200 may comprise a first roll support member 11, 21 forming the first roll compartment surface 110, 210, a second roll support member 12, 22 forming the second roll compartment surface 120, 220, and a third roll support member 13, 23 forming the third roll compartment surface 130, 230.

Optionally, each of the first, second and third roll support members of the same roll compartment 100, 200 is an individual member. That being the case, two adjacent roll compartments 100, 200 such as the first roll compartment 100 and the second roll compartment 200 of the dispenser 1 in FIGS. 1 to 3, may share a single roll support member 13.

As such, the third roll compartment surface 130 of the first roll compartment 100 may be formed on one side of the roll support member 13, and the second roll compartment surface 220 of the second roll compartment 200 may be formed on another side of the roll support member 13, opposite the one side.

The roll support members 11, 12, 13, 21, 22, 23 may for example be formed as separate members from the remainder of the housing 10, which are attached to the housing 10 during manufacture. For example, one or more of the roll support members 11, 12, 13, 21, 22, 23 may be attached to the back wall 52 and/or to the first pair of side walls 54 and/or to the second pair of side walls 56.

In the illustrated example, the first roll support member 11 of the first roll compartment 100 arranged to one out of the second pair of side walls 56. The second roll support member 12 of the first roll compartment 100 is arranged to a first out of the first pair of side walls 54. The third roll support member 13 is arranged to the back wall 52 of the housing 10.

Further, the first roll support member 21 of the second roll compartment 100 is similarly arranged to one out of the second pair of side walls 56. The second roll support member 22 of the second roll compartment 100 is arranged to the back wall 52 of the housing 10, and is, in fact, constituted by a same member 13, 22 serving also as the third roll support member 13 of the first roll compartment 100. The third roll support member 23 of the second roll compartment 200 is arranged to one out of the second pair of side walls 56.

Many variants are possible for arranging the roll support members for example, a roll support member may, where suitable, be arranged both to a back wall 52 of the dispenser 1 and to a side wall 54, 56 of the dispenser 1.

Optionally, the roll support members 11, 12, 13, 21, 22, 23 may be removably attached to the remainder of the housing 10. As such, the roll support members may be removed from the remainder of the housing 10 and replaced e.g. by new roll support members. Thus, if one or more of the roll support members becomes worn or breaks, it may be replaced, thus increasing the lifetime of the dispenser.

In the above, it is described how the proposed roll compartment surfaces 110, 120, 130, 210, 220, 230 may provide for the required support and centering of a roll positioned in the roll compartment 100, 200 of a dispenser during dispensing, when the dispenser 1 is arranged in different orientations with respect to a vertical direction.

Figure 6A:
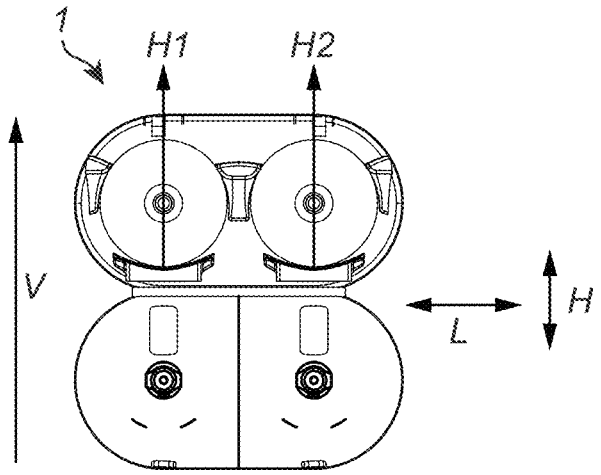
FIGS. 6*a* to 6*c* are a schematic views illustrating the dispenser of FIGS. 1 to 3 when arranged in different orientations with respect to a vertical direction.
Figure 6B:
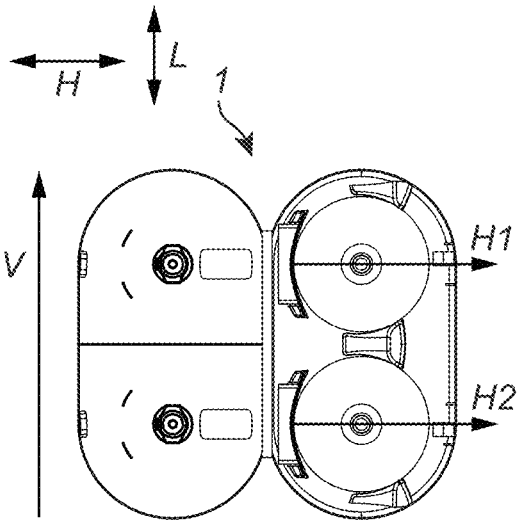
Figure 6C:
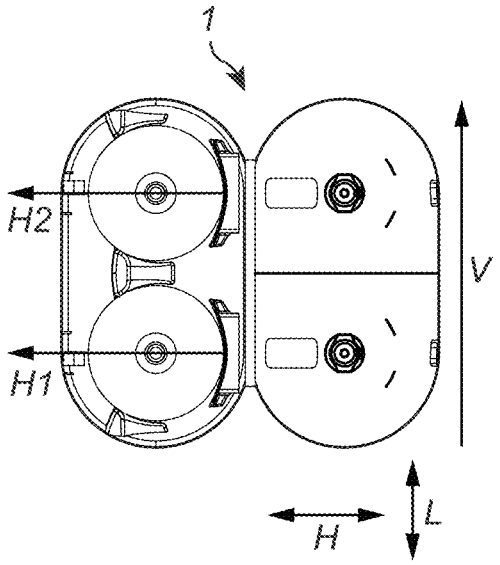

FIGS. 6*a* to 6*b* illustrate the dispenser 1 of FIGS. 1 to 3 as arranged three different orientations with respect to a vertical upward direction V. FIG. 6*a* illustrates an orientation where the dispenser height H is generally parallel to the vertical direction V, FIG. 6*b* illustrates a first orientation where the dispenser length L is generally parallel to the vertical direction V, and FIG. 6*c* illustrates a second orientation where the dispenser length L is generally parallel to the vertical direction V. Each orientation thus provides for different requirements when it comes to available surface e.g. on a vertical wall for suspending the dispenser 1, and for different requirements when it comes to the volume in the room necessary for allowing the opening of the cover 40 so as to allow introduction of rolls of material into the dispenser 1.

For completeness, it may be mentioned that also additional elements may be comprised in the dispenser e.g for hindering collapse of the roll 2, 2' during dispensing.

For example, and as illustrated in the dispenser of FIGS. 1 to 3, each roll compartment 100, 200 may comprise a central support bar 17, 27 arranged concentrically with the central width axis W1, W1 of the roll compartment 100, 200. Such a central support bar 17, 27 may facilitate positioning of a new roll in the roll compartment 100, 200. Further, the support bar 17, 27 may be effective to support at least a portion of the web-shaped material of the roll 2 in the case the roll collapses. When the roll compartment 100 comprises a central support bar 17, 27, this implies that the dispenser 1 is suitable for centrefeed rolls having an initial inner perimeter of a size sufficient to house the central support bar 17, 27.

In another example, and as illustrated in the dispenser of FIGS. 1 to 3, the dispenser 1 may comprise one or more roll side contact protrusions 19, 29 for each roll compartment 100, 200. Such roll side contact protrusions 19, 29 may protrude from the back wall 52 of the dispenser 1 and/or from a front wall opposing the back wall 52, such as in the illustrated dispenser 1, from the cover 3, towards the roll compartment 100, 200. As such, the roll side contact protrusions 19, 29 are intended to protrude in the width direction W of the dispenser 1, so as to contact or to penetrate an end surface perpendicular to the roll axis X, X' of a roll 2, 2'. As such, the roll side contact protrusions 19, 29 are intended to inhibit premature collapse and/or rotation of the roll 2, 2' inside the roll compartment 100, 200. The roll side contact protrusions 19, 29 may be arranged at a radial distance from the centre axis W1, W2 of the roll compartment 100, 200 less than the radius R of the imaginary circle mentioned in the above, i.e. less than the radius of a roll 2, 2' intended to be positioned in the roll compartment 100, 200.

Figure 7:
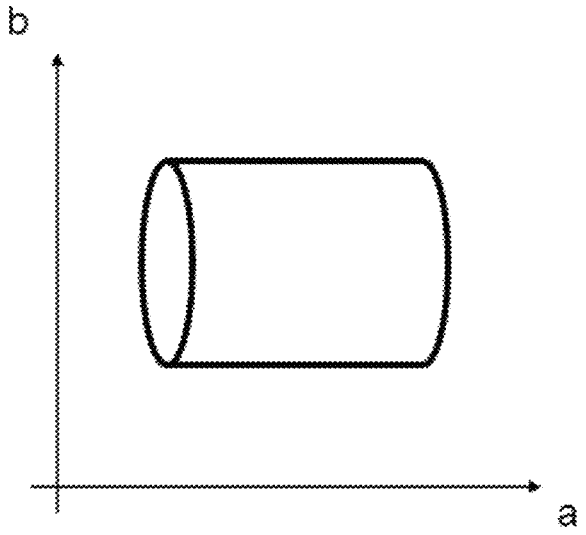
FIG. 7 is a sketch illustrating the meaning of the term "direction projection".

The term "direction projection along a direction" as used throughout the above is to encompass a projection onto a plane perpendicular to the direction (i.e. the direction is a normal to the plane). For explaining the term, FIG. 7 illustrates a cylinder having a height extending along a direction a and a diameter extending along a direction b. The direction projection of the cylinder along the direction a is hence a circle. The direction projection of the cylinder along the direction b is instead a rectangle.

It is to be understood that the present invention is not limited to the variants described above and illustrated in the drawings; rather, the skilled person will recognize that many changes and modifications may be made within the scope of the appended claims.

The invention claimed is:

1. A dispenser for dispensing a web-shaped absorbent material from at least one centrefeed roll of the web-shaped absorbent material, the roll defining a central roll axis, and, the dispenser extending along a length direction, a height direction perpendicular to the length direction, and a width direction perpendicular to the length direction and the height direction, the dispenser comprising a housing defining one or more roll compartments, each roll compartment being dimensioned for holding one roll of absorbent material during dispensing thereof, such that the roll axis is essentially parallel to the width direction, wherein each roll compartment is delimited by at least three separate roll compartment surfaces arranged to face an outer periphery of the roll in a direction perpendicular to the roll axis, and each roll compartment defining an central width axis parallel to the width direction, and a central height axis parallel to the height direction and crossing the width axis and, as seen in a direction projection of the dispenser in the width direction, each roll compartment encompasses an imaginary circle with a radius from the central width axis, and, for each roll compartment, each roll compartment surface comprises a roll contact surface portion being arranged so as to contact a circumference of the imaginary circle over an arc of the circumference comprising at least a contact angle measured clockwise from the central height axis, wherein the contact angle of the first roll contact surface portion is located in the range from 5 to 85 degrees or alternatively in the range from −5 to −85 degrees;

the contact angle of the second roll contact surface portion is located in the range from 95 to 175 degrees, the contact angle of the third roll contact surface portion is located in the range from −95 to −175 degrees, and each of the roll contact surface portions includes an arc shaped surface portion coextensive with the imaginary circle.

2. The dispenser according to claim 1, further comprising a cover arranged to the housing so as to assume an open position, in which a roll of web-shaped material is introducible in at least one of the one or more roll compartments, and a closed position, allowing dispensing of web-shaped material from a roll of web-shaped material when present in the roll compartment.

3. The dispenser according to claim 1, wherein the housing comprises a back wall extending generally in the length direction and in the height direction, and optionally a first pair of opposing side walls extending from the back wall and generally in the width direction and the height direction, and a second pair of opposing side walls extending from the back wall and generally in the width direction and in the length direction.

4. The dispenser according to claim 1, wherein, for each of the one or more roll compartments, the dispenser defines one dispensing opening arranged for dispensing of web material from the roll compartment to the outside of the dispenser at least along the width direction.

5. The dispenser according to claim 1, wherein the housing comprises a first roll compartment and a second roll compartment, the first and second roll compartments being arranged adjacent one another as seen in the length direction of the dispenser.

6. The dispenser according to claim 1, wherein the dispenser has a dispenser width in the width direction and the roll compartment surfaces extend continuously over at least 50% of the dispenser width.

7. The dispenser according to claim 1, wherein the dispenser has a dispenser width in the width direction and the roll contact surface portions extend continuously over at least 50% of the dispenser width.

8. The dispenser according to claim 1, wherein the roll contact surface portions of the first, second and third roll compartment surfaces are located in the same plane perpendicular to the width direction.

9. The dispenser according to claim 1, wherein each of the first, second and/or third roll compartment surfaces has an angular extension about the central width axis being no more than 90 degrees.

10. The dispenser according to claim 1, wherein each of the first, second and/or third roll compartment surfaces has an angular extension about the central width axis being at least 30 degrees.

11. The dispenser according to claim 1, wherein no more than the three roll contact surface portions are arranged so as to contact the circumference of the imaginary circle.

12. The dispenser according to claim 1, wherein the contact angle of the second roll contact surface portion is located in the range from 100 to 140 degrees, and the contact angle of the third roll contact surface portion is located in the range from −100 to −140 degrees.

13. The dispenser according to claim 1, wherein the contact angle of the first roll contact surface portion is located in the range from 5 to 30 degrees or alternatively located in the range from −5 to −30 degrees.

14. The dispenser according to claim 1, wherein each roll contact surface portion is arranged so as to contact the circumference of the imaginary circle over an arc of the circumference being less than a 5 degree arc of the circumference.

15. The dispenser according to claim 1, wherein each roll compartment surface further comprises an extension surface portion arranged radially outside the circumference of the imaginary circle, as seen from the central width axis.

16. The dispenser according to claim 15, wherein each one of the extension surface portions is arranged outside the circumference of the imaginary circle over an arc of the circumference comprising at least an extension angle as measured clockwise from the central height axis, wherein the extension angle of the first extension surface is 0 degrees and/or the extension angle of the second extension surface is 90 degrees and/or the angle of the third extension surface is −90.

17. The dispenser according to claim 1, wherein one or more of the first, second and third roll compartment surfaces is a curved surface having a radius of curvature being greater than the radius of the imaginary circle.

18. The dispenser according to claim 17, wherein the curved surface follows an arc of a circle having a radius of curvature being greater than the radius of the imaginary circle.

19. The dispenser according to claim 1, wherein the dispenser has a dispenser length in the length direction and a dispenser height in the height direction, the dispenser length being different from the dispenser height.

20. The dispenser according to claim 19, wherein the dispenser length is at least 1.5×the dispenser height.

21. The dispenser according to claim 1, wherein each roll compartment is delimited by a first roll support member forming the first roll compartment surface, a second roll support member forming the second roll compartment surface, and a third roll support member forming the third roll compartment surface, wherein each of the first, second and third roll support members of the roll compartment is an individual member.

22. The dispenser according to claim 21, wherein each one of the first, second and third roll support members of the housing is a separate member attached to the remainder of the housing.

23. The dispenser according to claim 21, wherein a roll compartment surface of the first roll compartment and a roll compartment surface of the second roll compartment are formed by opposite sides of a single roll support member.

24. The dispenser according to claim 1, wherein the housing further comprises a suspension arrangement adapted for suspending the dispenser to a generally vertical structure.

25. The dispenser according to claim 24, wherein the suspension arrangement is adapted for suspending the dispenser to the generally vertical structure with the height direction of the dispenser substantially extending along a vertical direction, and for alternatively suspending the dispenser to a generally vertical structure with the length direction of the dispenser substantially extending along a vertical direction.

* * * * *